United States Patent [19]

Lang et al.

[11] 4,318,712

[45] Mar. 9, 1982

[54] CATALYTIC COAL GASIFICATION PROCESS

[75] Inventors: Robert J. Lang, Baytown; Joanne K. Pabst, Crosby, both of Tex.

[73] Assignee: Exxon Research & Engineering Co., Florham Park, N.J.

[21] Appl. No.: 151,007

[22] Filed: May 19, 1980

Related U.S. Application Data

[63] Continuation-in-part of Ser. No. 93,784, Nov. 13, 1979, abandoned, which is a continuation-in-part of Ser. No. 925,664, Jul. 17, 1978, abandoned.

[51] Int. Cl.[3] ..... C10J 3/54

[52] U.S. Cl. ..... 48/202; 48/197 R; 48/210; 252/373

[58] Field of Search ..... 48/202, 206, 210, 197 R; 252/373, 476; 201/38

[56] References Cited

U.S. PATENT DOCUMENTS

| | | | |
|---|---|---|---|
| 3,689,240 | 9/1972 | Aldridge et al. | 48/202 |
| 3,775,072 | 11/1973 | White | 48/202 |
| 3,847,567 | 11/1974 | Kalina et al. | 48/202 |
| 4,069,304 | 1/1978 | Starkovich et al. | 48/202 |
| 4,094,650 | 6/1978 | Koh et al. | 48/202 |

FOREIGN PATENT DOCUMENTS 514302 11/1939 United Kingdom .

OTHER PUBLICATIONS

"Effect of Alkali Metal Catalysts on Gasification of Coal Char", Verou et al., Fuel, vol. 57, No. 4, 1978, pp. 194–200.

"Catalysis in the Interaction of Carbon with Steam and with Carbon Dioxide", Taylor et al., J. Am. Chem. Soc., vol. 43, 1921, pp. 2055–2071.

"The Use of Catalysts in Coal Gasification", Johnson, Catal Rev.-Sci. Engr., vol. 14, Nov. 1, 1976, pp. 131–152.

*Primary Examiner*—Peter F. Kratz

*Attorney, Agent, or Firm*—Yale S. Finkle

[57] ABSTRACT

A carbonaceous feed material, a potassium compound having a relatively poor catalytic activity as compared to that of potassium carbonate, and a sodium or lithium salt are introduced into a gasification reactor. The carbonaceous material is then gasified in the presence of the added potassium and sodium or lithium constituents. The added sodium or lithium salt apparently activates the relatively noncatalytic potassium compound thereby producing a substantial catalytic effect on the gasification reactions. In general, activation of the noncatalytic potassium compound will take place when the sodium or lithium compound introduced into the reactor is either a salt of a weak acid or a salt of a strong acid that is converted to a sodium or lithium salt of a weak acid in the reactor at gasification conditions.

16 Claims, 14 Drawing Figures

GASIFICATION RATE — % CARBON/HR.

CATALYTIC COAL GASIFICATION PROCESS

CROSS-REFERENCE TO RELATED APPLICATIONS

This application is a continuation-in-part of application Ser. No. 093,784, filed in the U.S. Patent and Trademark Office on Nov. 13, 1979 and now abandoned, which is a continuation-in-part of application Ser. No. 925,664, filed in the U.S. Patent and Trademark Office on July 17, 1978 and now abandoned.

BACKGROUND OF THE INVENTION

This invention relates to the gasification of carbonaceous materials such as oils, petroleum residua, coals and the like, and is particularly concerned with catalytic gasification operations carried out in the presence of alkali metal-containing catalysts.

It has long been recognized that certain alkali metal compounds can be employed to catalyst the gasification of carbonaceous material such as coal and other carbonaceous solids. Studies have shown that potassium carbonate, sodium carbonate, cesium carbonate and lithium carbonate will substantially accelerate the rate at which steam, hydrogen, carbon dioxide, oxygen and the like react with bituminous coal, subbituminous coal, lignite, petroleum coke, organic waste materials and similar carbonaceous solids to form methane, carbon monoxide, hydrogen, carbon dioxide and other gaseous products. Other alkali metal salts such as alkali metal chlorides, however, have a low catalytic activity when compared to that of the corresponding carbonate and will only accelerate the gasification reactions at a fraction of the rate obtainable with the alkali metal carbonates. It is known that of the alkali metal carbonates, cesium carbonate is the most effective gasification catalyst, followed by potassium carbonate, sodium carbonate and lithium carbonate, in that order. Because of the relatively high cost of cesium carbonate and the low effectiveness of lithium carbonate, most of the experimental work in this area which has been carried out in the past has been directed toward the use of potassium and sodium carbonate. The catalytic activity of sodium carbonate, however, is substantially lower than that of potassium carbonate, therefore attention has been focused in the past on the use of potassium carbonate as a gasification catalyst.

In addition to utilizing individual alkali metal salts as a catalyst for the gasification of a carbonaceous material, it has been proposed to utilize mixtures of alkali metal salts. Specific combinations of alkali metal salts that have been proposed include cesium carbonate and potassium carbonate, cesium carbonate and lithium carbonate, cesium carbonate and cesium chloride, potassium carbonate and lithium carbonate, and potassium carbonate and potassium chloride. When such mixtures of alkali metal salts are used to promote the gasification of a carbonaceous feed material, it is expected that the mixture will accelerate the gasification reactions less than if an equivalent amount of the more active alkali metal compound is used alone and more than if an equivalent amount of the less active alkali metal salt is employed. In a recent publication concerning the use of catalysts in coal gasification it was concluded that there is a substantial need for additional research in general areas related to the use of catalysts in coal gasification. Specifically, it was suggested that a study of catalyst combinations would be a promising area for future research.

In gasification processes using alkali metal-containing catalysts, the cost of the catalyst is a significant factor in determining the overall cost of the product gas. Potassium carbonate is relatively expensive, costing approximately $12.77 per pound mole of potassium. Thus, when potassium carbonate is utilized as a catalyst it is essential that the potassium constituents in the spent solids produced during gasification of the carbonaceous feed material be recovered and reused in the process in order to maintain catalyst cost at a reasonable level. When these potassium constituents are removed from the spent solids exiting the gasifier by water leaching, it has been found that only a portion of the potassium carbonate is recovered and that substantial quantities of makeup alkali metal compounds are therefore required. This adds appreciably to the cost of the gasification operation. In order to decrease the amount of alkali metal makeup compounds necessary, it has been suggested to further treat the char from the gasifier to recover water-insoluble alkali metal constituents by more sophisticated and expensive recovery processes.

The costs of other alkali metal compounds such as potassium chloride ($1.49 per pound mole of potassium), potassium sulfate ($3.29 per pound mole of potassium), sodium carbonate ($1.25 per pound mole of sodium), sodium chloride ($0.79 per pound mole of sodium) and sodium sulfate ($1.95 per pound mole of sodium) are substantially cheaper than potassium carbonate but these compounds have now been found to exhibit only a fraction of the catalytic activity exhibited by potassium carbonate. It would be highly desirable if the compounds mentioned above and other more abundant, less expensive potassium and sodium compounds could be effectively used as gasification catalysts thereby substantially decreasing the initial investment required in the catalyst and obviating the need for expensive secondary recovery techniques to decrease the amount of makeup alkali compounds that would otherwise be required to maintain the catalyst inventory at the required level.

SUMMARY OF THE INVENTION

The present invention provides an improved process for the catalytic gasification of a carbonaceous feed material. In accordance with the invention, it has now been found that catalyst costs incurred during the gasification of oils, petroleum residua, bituminous coal, subbituminous coal, lignite, organic waste materials, petroleum coke, coal liquefaction bottoms, oil shale, and other carbonaceous feed materials can be significantly reduced while at the same time obtaining unexpectedly high gasification rates by employing mixtures of inexpensive potassium compounds and sodium compounds as the catalyst. Laboratory tests have shown that when mixtures of high rank or low rank coal, potassium chloride or potassium sulfate, and sodium carbonate or sodium sulfate are injected into a reaction zone and the coal is subsequently gasified, surprisingly high gasification rates are obtained. These gasification rates are substantially higher than expected based on the low activity of the individual potassium and sodium compounds relative to that of potassium carbonate. This is a significant and unexpected discovery since the observed gasification rates are high enough to enable mixtures of these inexpensive potassium and sodium salts to be used as gasification catalysts in lieu of the substantially more expensive potassium carbonate. Because of the quantities in which catalysts are required in catalytic gasification operations, the overall savings made possible in a large gasification plant by the invention may be quite substantial.

In general, unexpectedly high gasification rates will be obtained when a carbonaceous feed material is introduced into a reaction zone along with a mixture of a potassium compound having a relatively poor catalytic activity as compared to that of potassium carbonate and a sodium or lithium compound selected from the group consisting of a weak acid salt of sodium or lithium and a strong acid salt of sodium or lithium that is converted to a weak acid salt in the reaction zone at reaction conditions, and the carbonaceous material is subsequently gasified. The gasification rate obtained will normally be greater than the weighted average of the separate rates obtained by gasifying the carbonaceous material in the presence of the potassium compound only and in the presence of the sodium or lithium compound only, wherein the weighted average is based upon the concentration of the potassium and sodium or lithium compounds expressed respectively in potassium-to-carbon and sodium-to-carbon or lithium-to-carbon atomic ratios. For mixtures of certain relatively noncatalytic potassium and sodium compounds, the gasification rate obtained will be nearly as great as the rate obtained when potassium carbonate alone is introduced into the reaction zone with the feed material in an amount that yields the same alkali metal-to-carbon atomic ratio as that of the mixture. Evidently, the sodium or lithium compound activates the poorly catalytic potassium compound thereby producing a substantial catalytic effect on the gasification rate of the carbonaceous feed material.

In accordance with the invention, the use of catalysts containing mixtures of inexpensive potassium and sodium compounds reduces the initial catalysts cost and the cost of makeup catalyst and at the same time permits the attainment of high gasification rates. The use of such mixtures also obviates the need for expensive secondary catalyst recovery procedures. As a result, the invention makes possible substantial savings in gasification operations and permits the generation of product gases at significantly lower cost than would normally otherwise be the case.

DESCRIPTION OF THE PREFERRED EMBODIMENTS

Figure 1:
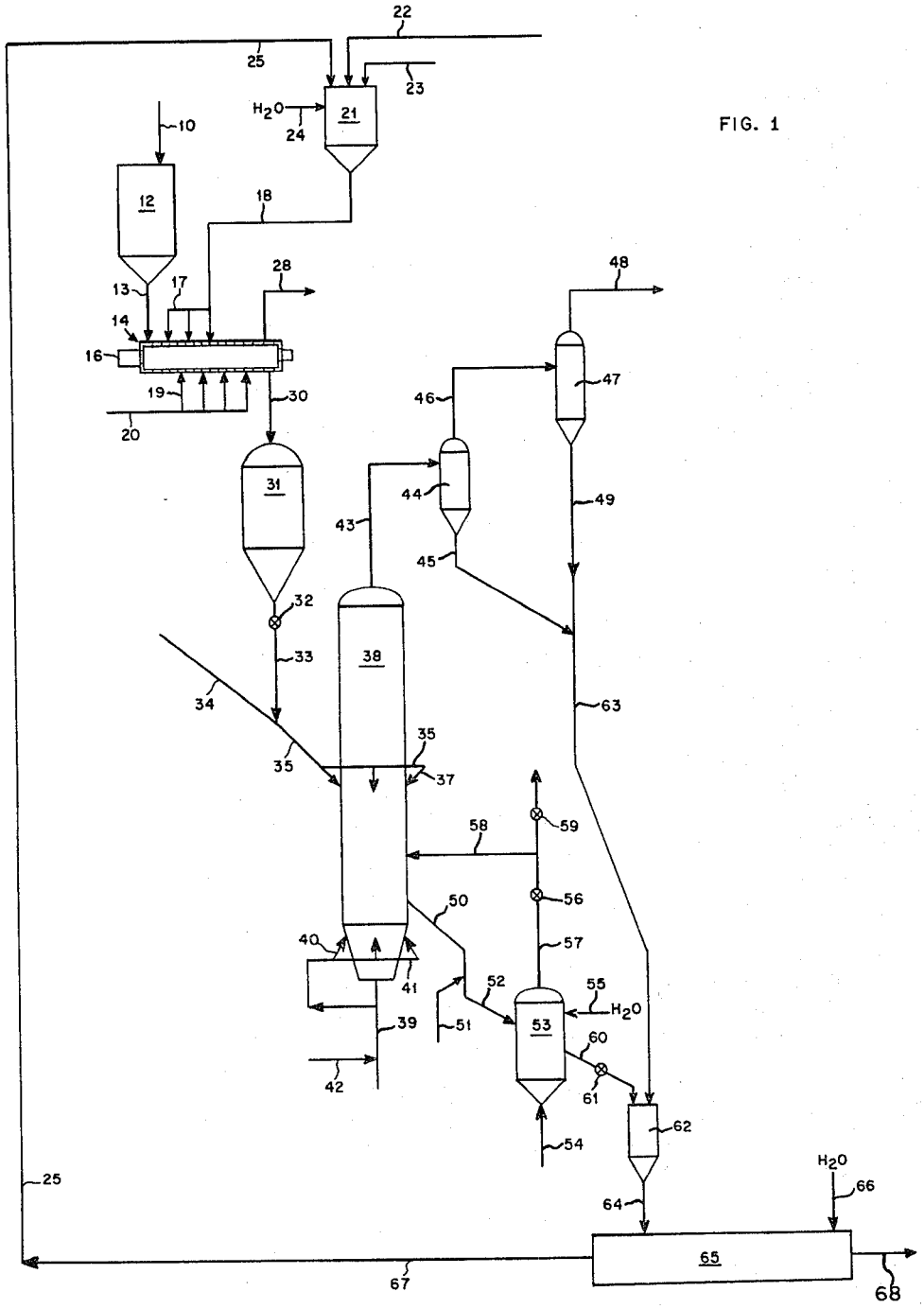
FIG. 1 in the drawing is a schematic flow diagram of a process for the gasification of coal carried out in accordance with the invention.

The process depicted in FIG. 1 is one for the gasification of bituminous coal, subbituminous coal, lignite, organic waste materials or similar carbonaceous solids in the presence of added sodium and potassium compounds. It will be understood that the invention is not restricted to this particular gasification process and instead may be employed in any of a wide variety of fixed bed, moving bed and fluidized bed gasification operations in which alkali metal compounds are used to promote the reaction of steam, hydrogen, carbon dioxide, or a similar gasification agent with carbonaceous feed materials and a char, coke or other solid product containing alkali metal residues is recovered. Many such operations have been described in the technical literature and will be familiar to those skilled in the art. It will also be understood that the process of the invention may be carried out in the absence of catalyst stabilizers such as alkaline earth fluorides.

In the process shown, a solid carbonaceous feed material such as a bituminous coal, subbituminous coal, lignite or the like, which has been crushed and screened to a particle size of about 8 mesh or smaller on the U.S. Sieve Series Scale is fed into the system through line 10 from a coal preparation plant or storage facility which is not shown in the drawing. The solids introduced through line 10 are fed into a hopper or similar vessel 12 from which they are passed through line 13 into a feed preparation zone 14. The feed preparation zone shown includes a screw conveyor or similar device, not shown in the drawing, which is powered by a motor 16, a series of spray nozzles or the like 17 for the spraying of a solution or slurry of alkali metal compounds introduced through line 18 onto the solids as they are moved through the preparation zone by the conveyor, and nozzles or the like 19 for the introduction of steam from line 20 into the preparation zone to heat the solids and drive off moisture. The alkali metal solution or slurry fed through line 18 is prepared by introducing sodium and potassium salts or other sodium and potassium compounds into mixing vessel 21 as indicated by lines 22 and 23, respectively, and dissolving or slurrying these in water or other suitable solvent admitted through line 24. Alkali metal solution recycled from the catalyst recovery zone through line 25 as described hereafter may also be used. Steam is withdrawn from the preparation zone 14 through line 28 and will normally be passed to a condenser or heat exchanger not shown for the recovery of heat and condensate which can be used as makeup water or the like.

The potassium compound introduced into mixing vessel 21 through line 23 will normally be an inexpensive compound which has a relatively poor catalytic activity as compared to that of potassium carbonate. "Relatively poor catalytic activity as compared to that of potassium carbonate" as used herein refers to a gasification rate obtained from gasifying a carbonaceous material in the presence of a sufficient amount of a potassium compound to yield an atomic ratio of potassium cations-to-carbon atoms of about 0.03 or greater that is about one-half or less that of the rate obtainable by gasifying the same material in the presence of an equivalent amount of potassium carbonate. Examples of such potassium compounds include potassium chloride, potassium sulfate, and similar potassium salts of a strong acid. "Strong acid" as used herein refers to an organic or inorganic acid having an ionization constant greater than about $1\times10^{-3}$ at 25° C.

The sodium compound introduced into mixing vessel 21 through line 22 will normally be either a sodium salt of a weak acid or a sodium salt of a strong acid that is converted, either temporarily or permanently, into a weak acid salt of sodium when subjected to gasification conditions in the presence of the potassium compound. "Weak acid" as used herein refers to an organic or inorganic acid having an ionization constant less than about $1\times10^{-3}$ at 25° C. Examples of suitable sodium compounds that are salts of weak acids include sodium hydroxide, sodium carbonate, sodium bicarbonate, sodium sulfide, sodium oxalate, sodium acetate, and the like. Examples of sodium salts of strong acids that may be used in conjunction with potassium sulfate because they are temporarily or permanently converted to weak acid salts include sodium chloride, sodium sulfate and sodium nitrate. The actual sodium compound used will normally depend upon its availability, cost, degree of solubility and the potassium compound utilized.

It has been surprisingly found that when a mixture of one of the potassium and one of the sodium compounds referred to above is injected into a catalytic gasification zone with a carbonaceous feed material which is subsequently gasified in the zone, a gasification rate is obtained that is greater than the weighted average of the separate rates obtained when the potassium compound alone and the sodium compound alone are injected into the gasification zone with the feed material in an amount that yields the same alkali metal-to-carbon atomic ratio as that of the mixture and is therefore greater than the rate that would normally be expected by one of ordinary skill in the art. Apparently, the poorly catalytic potassium compound is activated by the sodium compound thereby producing a substantial catalytic effect on the gasification rate of the carbonaceous feed material. Normally, a concentration of the sodium compound sufficient to yield a sodium-to-potassium mole ratio of 1.5 will completely activate the potassium compound. In some mixtures, however, lesser amounts of the sodium compound may be used to activate the potassium compound without much activity loss. When the potassium compound is potassium sulfate, a sufficient amount of the sodium compound is normally used to yield a sodium-to-potassium mole ratio of between about 0.25 and about 1.5, preferably between about 0.5 and about 1.0. When the potassium compound used is potassium chloride, a sufficient amount of the sodium compound is used to yield a sodium-to-potassium mole ratio between about 0.5 and 1.5, preferably between about 0.8 and about 1.35.

The actual mechanism by which the sodium compound activates the potassium compound in the presence of the carbonaceous feed material and under gasification conditions is not fully understood. It is believed, however, that certain interactions between the compounds take place which eventually result in transforming the poorly catalytic strong acid salt of potassium into a catalytically active weak acid salt. For example, the following equations are belived to represent the reactions that take place when the potassium compound utilized is potassium sulfate and the sodium compound utilized is sodium carbonate.

$$K_2SO_4 + Na_2CO_3 \longrightarrow Na_2SO_4 + K_2CO_3 \quad (1)$$

$$K_2SO_4 + Na_2S \longrightarrow K_2S + Na_2SO_4 \quad (2)$$

As can be seen in equations (1) and (2), the anion associated with the potassium compound and the anion associated with the sodium compound exchange with one another to produce $K_2CO_3$ and $Na_2SO_4$, which is reduced in the presence of carbon, hydrogen or carbon monoxide under gasification conditions to $Na_2S$. The $Na_2S$ then undergoes an anion exchange with the $K_2SO_4$ to produce $K_2S$ and additional $Na_2SO_4$, which also is reduced to $Na_2S$. The net results of these reactions is the conversion of the poorly catalytic $K_2SO_4$, a strong acid salt of potassium, into catalytically active $K_2CO_3$ and $K_2S$, weak acid salts of potassium. The $Na_2S$ that is formed is also catalytically active and is believed to add to the overall resultant catalytic activity of the original combination. It is believed that the weak acid salts, $K_2CO_3$, $K_2S$ and $Na_2S$, react with the acidic carbonaceous solids to form an alkali metal-char "salt", which is believed to be the active site in gasification. Thus, in the case where the potassium compound is $K_2SO_4$ and the sodium compound is $Na_2CO_3$, both the potassium and sodium cations end up catalyzing the gasification of the carbonaceous solids.

If the potassium compound is potassium sulfate and the sodium compound is sodium sulfate, the following equations are believed to represent the reactions that take place.

$$K_2SO_4 + Na_2SO_4 \quad (3)$$

$$\downarrow$$

$$K_2SO_4 + Na_2S \longrightarrow K_2S + Na_2SO_4 \quad (4)$$

In the above-illustrated case, an anion exchange cannot take place between $K_2SO_4$ and $Na_2SO_4$ since the anions are identical. It is theorized, however, that the strong acid salt $Na_2SO_4$ is reduced in the presence of carbon, carbon monoxide or hydrogen under gasification conditions to the weak acid salt $Na_2S$, which when undergoes an anion exchange with the $K_2SO_4$ to produce $K_2S$ and $Na_2SO_4$. The $Na_2SO_4$ thus formed is also reduced in the presence of carbon, carbon monoxide or hydrogen to $Na_2S$. The net result of these reactions is the formation of catalytically active $K_2S$ and $Na_2S$ and therefore, like the example illustrated in equations (1) and (2) above, both the potassium and sodium cations end up catalyzing the gasification of the carbonaceous solids.

It is believed that equations (5) and (6) set forth below represent the mechanism by which potassium sulfate is activated by sodium chloride.

$$K_2SO_4 + 2NaCl \longrightarrow 2KCl + Na_2SO_4 \quad (5)$$

$$2KCl + Na_2S \longrightarrow K_2S + 2NaCl \quad (6)$$

As can be seen, the potassium and sodium compounds exchange anions thereby forming KCl and $Na_2SO_4$. The $Na_2SO_4$ is then reduced under gasification conditions and in the presence of carbon, hydrogen or carbon monoxide to $Na_2S$, which undergoes an anion exchange with KCl to yield catalytically active $K_2S$ and catalytically inactive NaCl, one of the original reactants. Thus, unlike the examples illustrated in equations (1) through (4) above, only the potassium cations end up catalyzing the gasification reactions.

As stated previously, any weak acid salt of sodium may be used to activate the relatively noncatalytic potassium compound, however, only certain strong acid sodium salts will be effective for this purpose. In general, only strong acid salts of sodium that are either temporarily or permanently converted to weak acid sodium salts under gasification conditions and in the presence of the potassium compound to be activated can be utilized. The examples illustrated by equations (3) through (6) above represent two cases in which relatively noncatalytic $K_2SO_4$ is activated by a strong acid sodium salt that is converted into a weak acid salt. In the example illustrated by equations (3) and (4), the strong acid sodium salt $Na_2SO_4$ undergoes reduction and is thereby permanently converted to the weak acid salt $Na_2S$. In the example illustrated by equations (5) and (6), the strong acid salt NaCl is converted to the weak acid salt $Na_2S$ in a two-step process. First the NaCl participates in an anion exchange with the $K_2SO_4$ to form the strong acid salt $Na_2SO_4$ which then undergoes reduction to $Na_2S$. The $Na_2S$, however, then exchanges anions with KCl to reform the strong acid salt NaCl. This example, therefore, represents a case where a strong acid sodium salt is only temporarily converted to a weak acid salt. An example of a strong acid salt of sodium which is neither temporarily nor permanently converted to a weak acid sodium salt under gasification conditions in the presence of $K_2SO_4$ and therefore will not activate $K_2SO_4$ is $Na_3PO_4$. An example of a strong acid salt of sodium which is neither temporarily nor permanently converted to a weak acid sodium salt under gasification conditions in the presence of KCl and therefore will not activate KCl is NaCl.

The total quantity of the sodium and potassium compounds used will normally be sufficient to provide a combined added alkali metal-to-carbon atomic ratio in excess of about 0.03:1, preferably in excess of 0.04:1 or 0.05:1. When the potassium compound is potassium chloride, a combined alkali metal-to-carbon atomic ratio above about 0.08:1 is normally desired. Generally speaking, from about 5% to about 50% by weight of sodium and potassium compounds, based on the coal or other carbonaceous feed material will be employed. From about 10% to about 35% by weight is generally preferred. The higher the mineral content of the feed material, the more sodium and potassium compounds that should normally be used.

Referring again to FIG. 1, the feed solids which are impregnated with sodium and potassium compounds in feed preparation zone 14 are withdrawn through line 30 and passed to a feed hopper or similar vessel 31. From here they are discharged through a star wheel feeder or a similar device 32 in line 33 at an elevated pressure sufficient to permit their entrainment in a stream of steam, recycle product gas, inert gas or other carrier gas introduced into the system through line 34. The carrier gas and entrained solids are passed through line 35 into manifold 36 and fed through multiple feed lines 37 and nozzles, not shown in the drawing, into gasifier 38. In lieu of or in addition to hopper 31 and star wheel feeder 32, the feed system employed may include parallel lock hoppers, pressurized hoppers, aerated standpipes operated in series, or other apparatus for raising the input feed solid stream to the required pressure level.

Gasifier 38 comprises a refractory-lined vessel containing a fluidized bed of carbonaceous solids extending upward within the vessel above an internal grid or similar distribution device not shown in the drawing. The solids are maintained in the fluidized state within the gasifier by means of a mixture of steam and air or oxygen injected through bottom inlet line 39 and multiple nozzles 40 connected to manifold 41. Sufficient air or oxygen is added to the steam through line 42 to maintain the fluidized bed at the desired temperature. The gasifier pressure will normally be between atmospheric and about 2000 psig, preferably between about 100 psig and about 800 psig and most preferably between about 400 psig and about 600 psig. The temperature maintained in the gasifier will normally range between about 1000° F. and about 1600° F., preferably between about 1100° F. and about 1500° F. and most preferably between about 1200° F. and about 1400° F. Under these conditions, the added sodium and potassium compounds result in the production of an unexpected and substantial catalytic effect on the steam gasification reaction thereby resulting in the production of a gas composed primarily of hydrogen, carbon monoxide and carbon dioxide. Other reactions will also take place and some methane will normally be formed depending on the gasification conditions. In some cases it may be desirable to inject carbon monoxide and hydrogen into the gasifier to prevent the net production of carbon monoxide and hydrogen with the result that the net reaction products are carbon dioxide and methane. Such gasification systems are described in detail in U.S. Pat. Nos. 4,094,650 and 4,118,204, the disclosures of which are hereby incorporated by reference. In such systems, heat is supplied by the exothermic reactions that take place in the gasifier upon the injection of carbon monoxide and hydrogen and the use of air or oxygen is normally not required.

The gas leaving the fluidized bed in gasifier 38 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 43 is passed to cyclone separator or similar device 44 for removal of larger fines. The overhead gas then passes through line 46 into a second separator 47 where smaller particles are removed. The gas from which the solids have been separated is taken overhead from separator 47 through line 48 and the fines are discharged downward through dip legs 45 and 49. These fines may be returned to the gasifier or passed to the catalyst recovery section of the process as discussed hereafter. After entrained solids have been separated from the raw product gas, the gas stream may be passed through suitable heat exchange equipment for the recovery of heat and subsequently passed downstream for further processing.

Char particles containing carbonaceous material, ash and alkali metal residues are continuously withdrawn through line 50 from the bottom of the fluidized bed in gasifier 38. The particles flow downward through line 50 countercurrent to a stream of steam or other elutriating gas introduced through line 51. Here a preliminary separation of solids based on differences in size and density takes place. The lighter particles containing a relatively large amount of carbonaceous material tend to be returned to the gasifier and the heavier particles having a relatively high content of ash and alkali metal residues continue downward through line 52 into fluidized bed withdrawal zone 53. Steam or other fluidizing gas is introduced into the bottom of the withdrawal zone through line 54 to maintain the bed in the fluidized state. Water may be introduced through line 55 in order to cool the particles and facilitate their further processing. The withdrawal rate is controlled by regulating the pressure within zone 53 by means of throttle valve 56 in overhead line 57. The gases from line 57 may be returned to the gasifier through line 58 or vented through valve 59. From vessel 53 the solid particles are passed through line 60 containing valve 61 into hopper 62. The char fines recovered from the raw product gas through dip legs 45 and 49 may be combined with the char particles withdrawn from the gasifier by passing the fines through line 63 into hopper 62.

The particles in hopper 62 will contain sodium and potassium residues composed of water-soluble and water-insoluble sodium and potassium compounds. These particles are passed from hopper 62 through line 64 into catalyst recovery unit 65. The catalyst recovery unit will normally comprise a multistage countercurrent extraction system in which the particles containing the sodium and potassium residues are countercurrently contacted with water introduced through line 66. An aqueous solution of sodium and potassium compounds is recovered from the unit and may be recycled through lines 67 and 25 to the catalyst preparation unit or mixing vessel 21. Particles from which substantially all of the soluble sodium and potassium constituents have been extracted are withdrawn from the catalyst recovery unit through line 68. These solids will normally contain substantial quantities of sodium and potassium present in the form of sodium and potassium aluminosilicates and other water-insoluble compounds. These compounds are formed in part by the reaction of the sodium and potassium compounds added to catalyze the gasification reaction with mineral matter in the coal and other feed material. In general, from about 15% to as much as 50% of the added alkali metal constituents will be converted into alkali metal aluminosilicates and other water-insoluble compounds. By employing a mixture of inexpensive potassium and sodium compounds in accordance with the process of the invention in lieu of the more expensive potassium carbonate and other previously known catalysts, the need to recover and reuse the sodium and potassium compounds tied up as water-insoluble alkali metal residues by expensive and sophisticated secondary recovery methods is obviated.

In the embodiment of the invention described above, the feed solids are impregnated with a solution containing a mixture of sodium and potassium compounds prior to their introduction into the gasifier 38. It will be understood that other methods of introducing the sodium and potassium compounds into the gasification zone may be utilized. For example, the compounds may be mixed in the solid state with the carbonaceous feed particles and the mixture may be subsequently passed into the gasifier. In some cases it may be desirable to introduce the feed solids, the sodium compound and the potassium compound through separate lines into gasifier 38. Other methods for separate introduction of the sodium and potassium compounds into this system will be apparent to those skilled in the art.

The nature and objects of the invention are further illustrated by the results of laboratory and pilot plant gasification studies which show that unexpectedly high gasification rates are obtained by utilizing certain combinations of sodium and potassium compounds, and lithium and potassium compounds as catalysts. In the first series of tests, about 2 grams of Illinois No. 6 coal, a high rank bituminous coal, was crushed and mixed with varying amounts of finely divided alkali metal compounds and combinations of such compounds. The resultant mixture was then dampened with about one milliliter of distilled water and pyrolyzed for about 15 minutes at about 1400° F. in a retort under an inert nitrogen atmosphere to remove volatile hydrocarbons. A portion of the resultant char, containing between about 0.2 and about 0.5 grams of carbon, was crushed to between about 30 and about 100 mesh on the U.S. Sieve Series Scale then steam-gasified at a temperature of about 1200° F., 1300° F. or 1400° F., and essentially atmospheric pressure in a laboratory bench scale gasification unit. The gasification rate obtained for each char sample was determined. The char not gasified was ashed to determine the amount of carbon present and the alkali metal cation-to-carbon atomic ratio was then calculated. The results of these tests are set forth in FIGS. 2 through 13. In all cases the gasification rate is expressed as the conversion weighted average rate in percent of carbon present per hour over the interval of 0–90% carbon conversion.

Figure 2:
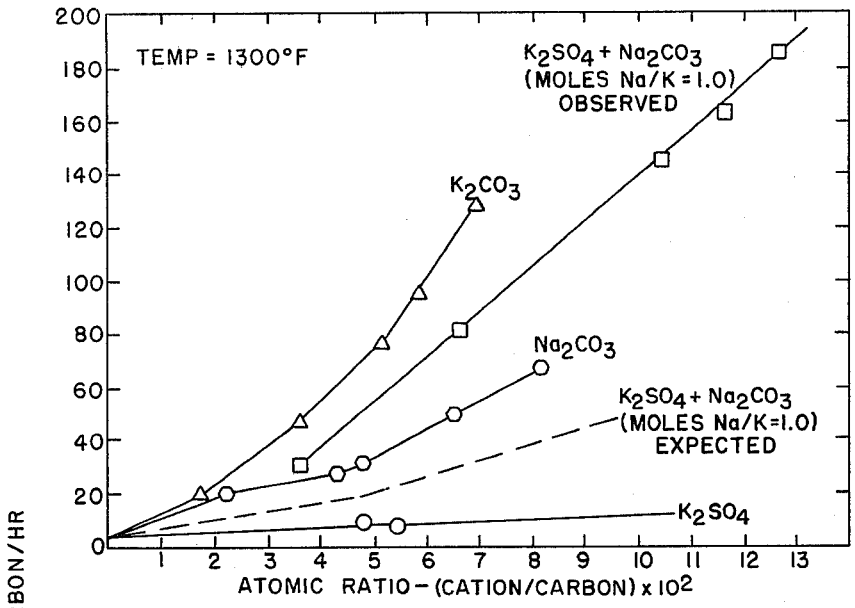
FIG. 2 is a plot illustrating that unexpectedly high gasification rates are obtained at 1300° F. by using a mixture of potassium sulfate and sodium carbonate which is equimolar in potassium and sodium to catalyze the gasification of a high rank coal.

FIG. 2 sets forth the steam gasification rate data obtained at 1300° F. from char impregnated with various concentrations of potassium carbonate, potassium sulfate, sodium carbonate and a mixture of potassium sulfate and sodium carbonate. If can be seen in FIG. 2 that the relatively expensive potassium carbonate yielded much greater gasification rates than did the less expensive potassium sulfate and sodium carbonate and is therefore a much more active gasification catalyst than either of the latter two compounds.

The dashed line in FIG. 2 represents the weighted average of the gasification rates observed at a particular alkali metal cation-to-carbon atomic ratio for potassium sulfate alone and for sodium carbonate alone and therefore illustrates the gasification rates that one of ordinary skill in the art would expect to observe when a mixture of sodium carbonate and potassium sulfate is used as a catalyst. The expected gasification rate for such as mixture which was equimolar in sodium and potassium (moles Na/K = 1.0) and yielded an atomic ratio of 0.066 alkali metal cations per carbon atom was calculated as follows. The observed rate of about 51% carbon per hour for a concentration of sodium carbonate that yielded an atomic ratio of 0.066 sodium cations per carbon atom was added to the observed rate of about 9.0% carbon per hour for a concentration of potassium sulfate that yielded an atomic ratio of 0.066 potassium cations per carbon atom and the resultant value of 60% carbon per hour was divided by 2 to yield the expected rate of 30% carbon per hour. This rate was then plotted against the atomic ratio of 0.066 cations per carbon atom where 0.033 of the cations were potassium cations and the other 0.033 were sodium cations. The expected gasification rates for mixtures of sodium carbonate and potassium sulfate that were equimolar in sodium and potassium but yielded alkali metal cation-to-carbon atomic ratios of other values were calculated in a manner similar to that described above.

As can be seen in FIG. 2, the actual gasification rates observed using mixtures of potassium sulfate and sodium carbonate were much greater than the expected rates represented by the dashed line and approached the rates obtainable with equivalent concentrations of potassium carbonate. The actual observed gasification rate for an atomic ratio of 0.066 potassium and sodium cations per carbon atom was 83% carbon per hour as compared to the 30% carbon per hour that was expected. Furthermore, the actual observed rate of 83% carbon per hour for the mixture at an atomic ratio of 0.066 potassium and sodium cations per carbon atom was much greater than the 9.0% per hour obtained for potassium sulfate at an atomic ratio of 0.066 potassium cations per carbon atom and was also greater than the 51% carbon per hour obtained for sodium carbonate at an atomic ratio of 0.066 sodium cations per carbon atom. In view of the foregoing, the gasification rates obtained using mixtures of potassium sulfate and sodium carbonate as a catalyst at 1300° F. are surprising and unexpected.

Figure 3:
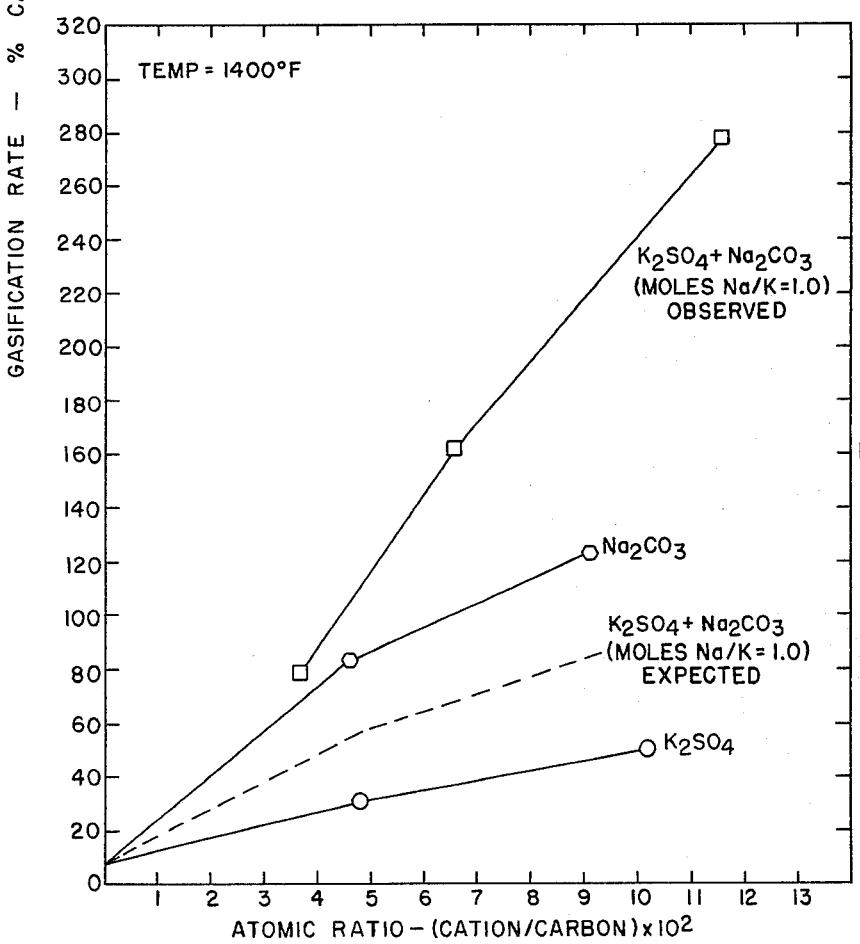
FIG. 3 is a plot illustrating that unexpectedly high gasification rates are obtained at 1400° F. by using a mixture of potassium sulfate and sodium carbonate which is equimolar in potassium and sodium to catalyze the gasification of a high rank coal.
Figure 4:
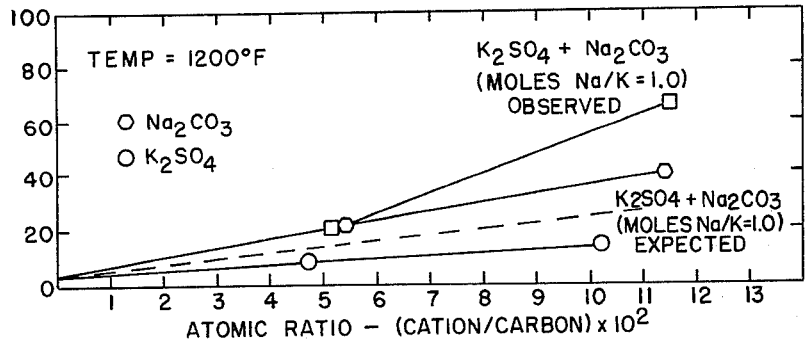
FIG. 4 is a plot illustrating that unexpectedly high gasification rates are obtained at 1200° F. by using a mixture of potassium sulfate and sodium carbonate which is equimolar in potassium and sodium to catalyze the gasification of a high rank coal.

FIGS. 3 and 4 set forth the steam gasification rate data obtained at temperatures of 1400° F. and 1200° F., respectively, when using mixtures of potassium sulfate and sodium carbonate that were equimolar in potassium and sodium. As can be seen in the two Figures, the actual gasification rates observed for the mixture at both temperatures are considerably greater than the expected rates, which are again represented by a dashed line and calculated as discussed previously in reference to FIG. 2. FIGS. 2 through 4 taken together clearly show that unexpectedly high gasification rates are obtained when using mixtures of potassium sulfate and sodium carbonate at temperatures between 1200° F. and 1400° F. Based upon this data it is reasonable to conclude that gasification rates greater than the weighted average of the separate rates obtained by gasification in the presence of potassium sulfate alone and in the presence of sodium carbonate alone would be obtained over a temperature range of about 1100° F. to about 1500° F.

Figure 5:
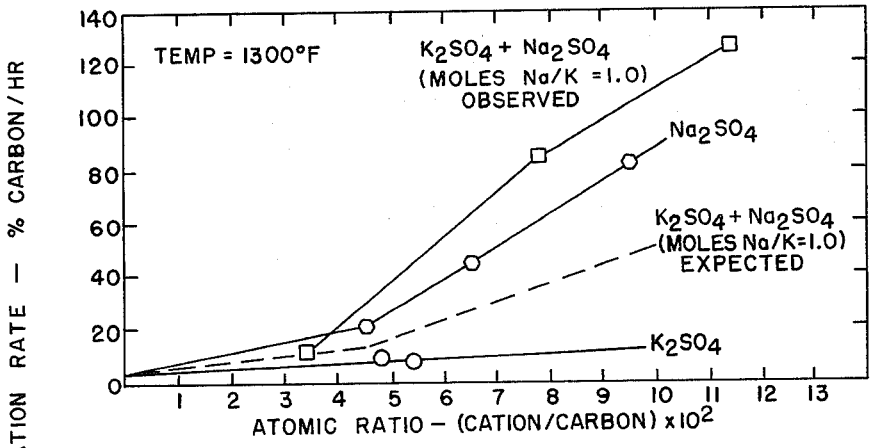
FIG. 5 is a plot illustrating that unexpectedly high gasification rates are obtained at 1300° F. by using a mixture of potassium sulfate and sodium sulfate which is equimolar in potassium and sodium to catalyze the gasification of a high rank coal.
Figure 6:
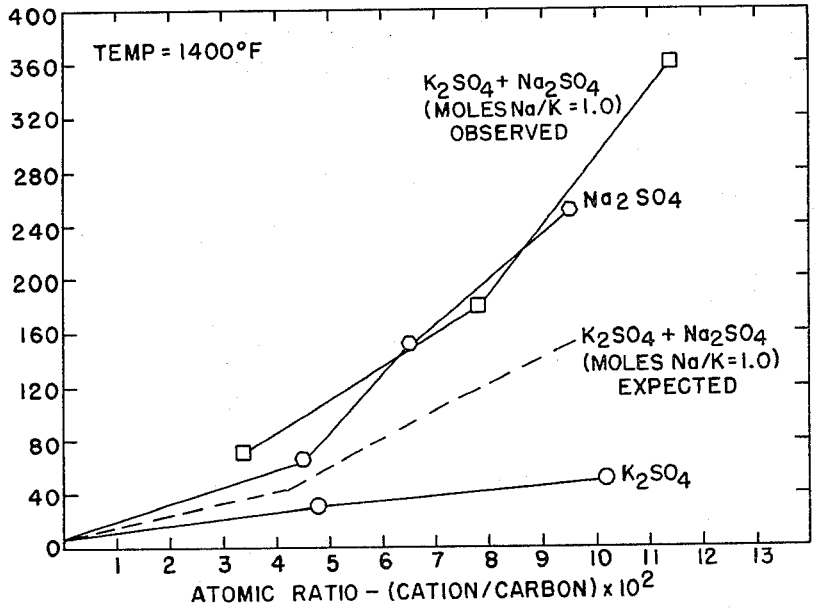
FIG. 6 is a plot illustrating that unexpectedly high gasification rates are obtained at 1400° F. by using a mixture of potassium sulfate and sodium sulfate which is equimolar in potassium and sodium to catalyze the gasification of a high rank coal.
Figure 7:
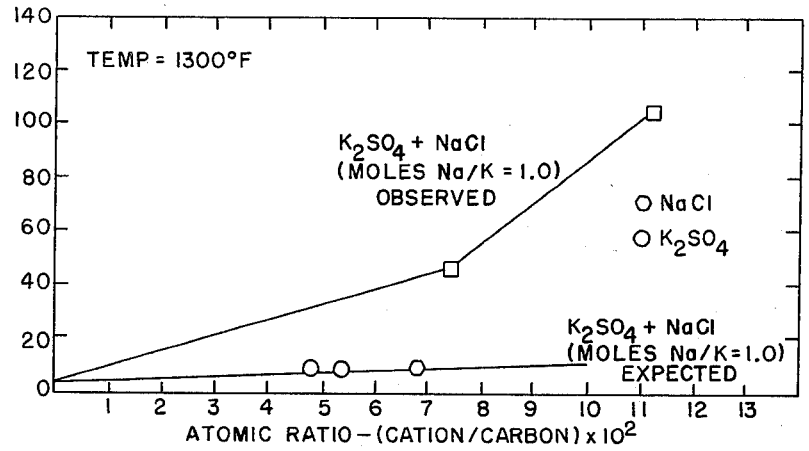
FIG. 7 is a plot illustrating that unexpectedly high gasification rates are obtained at 1300° F. by using a mixture of potassium sulfate and sodium chloride which is equimolar in potassium and sodium to catalyze the gasification of a high rank coal.
Figure 8:
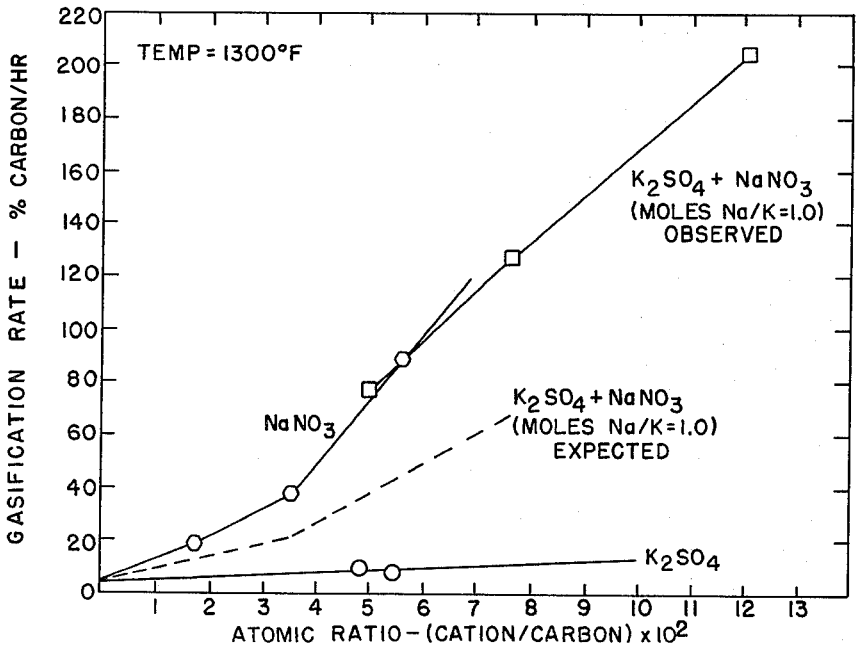
FIG. 8 is a plot illustrating that unexpectedly high gasification rates are obtained at 1300° F. by using a mixture of potassium sulfate and sodium nitrate which is equimolar in potassium and sodium to catalyze the gasification of a high rank coal.

The data set forth in FIGS. 5 through 8 indicate that surprisingly high gasification rates can also be obtained by utilizing potassium sulfate in combination with various sodium salts other than sodium carbonate. FIGS. 5 and 6 show that unexpectedly high rates are obtained at 1300° F. and 1400° F., respectively, using mixtures of potassium sulfate and sodium sulfate that are equimolar in potassium and sodium as gasification catalysts. FIG. 8 makes a similar showing at 1300° F. for mixtures of potassium sulfate and sodium nitrate that are equimolar in potassium and sodium. In these three Figures the rates one of ordinary skill in the art would expect are represented by dashed lines and were calculated as discussed previously in reference to FIG. 2. FIG. 7 shows that surprisingly high gasification rates are obtained at 1300° F. using mixtures of potassium sulfate and sodium chloride that are equimolar in potassium and sodium. In FIG. 7 the gasification rates for potassium sulfate alone and for sodium chloride alone fall on the same line. This line, therefore, also represents the gasification rates that would be expected for mixtures of the two salts that are equimolar in potassium and sodium. The gasification rates actually observed for the mixtures of potassium sulfate and either sodium sulfate, sodium chloride or sodium nitrate, like the rates observed for a mixture of potassium sulfate and sodium carbonate, are greater than the weighted average of the rates obtained by gasification in the presence of potassium sulfate alone and in the presence of sodium sulfate, sodium chloride or sodium nitrate alone and are therefore unexpected.

Figure 9:
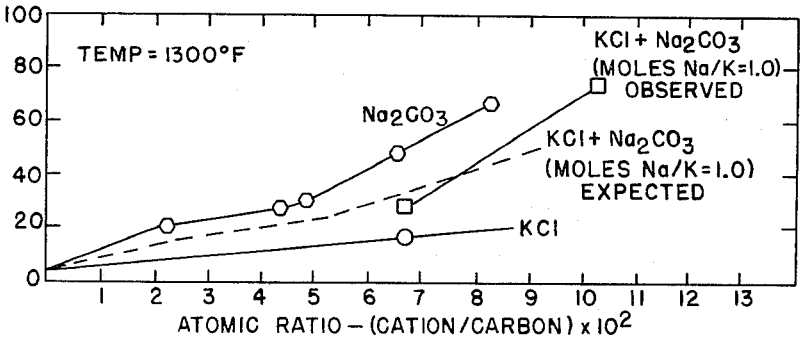
FIG. 9 is a plot illustrating that unexpectedly high gasification rates are obtained at 1300° F. by using a mixture of potassium chloride and sodium carbonate which is equimolar in potassium and sodium to catalyze the gasification of a high rank coal.
Figure 10:
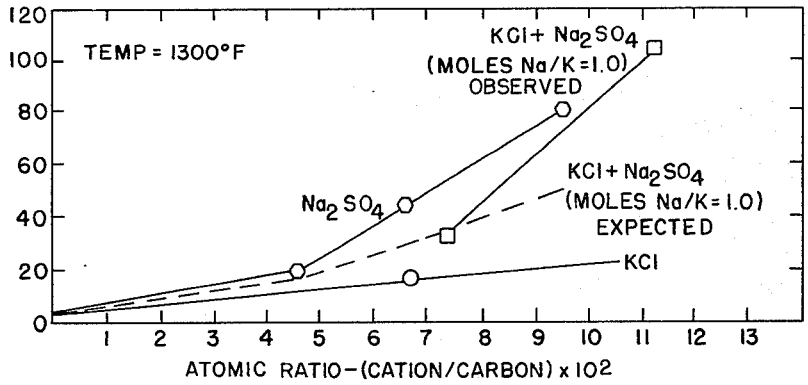
FIG. 10 is a plot illustrating that unexpectedly high gasification rates are obtained at 1300° F. by using a mixture of potassium chloride and sodium sulfate which is equimolar in potassium and sodium to catalyze the gasification of a high rank coal.

FIGS. 9 and 10 illustrate that catalysts comprised of a mixture of potassium chloride and one of various inexpensive sodium salts will yield higher than expected gasification rates when the catalyst concentration is above a certain value. FIG. 9 shows that surprisingly high rates are obtained at 1300° F. when a mixture of potassium chloride and sodium carbonate that is equimolar in potassium and sodium is employed in sufficient concentrations to yield an atomic ratio greater than about 0.08 alkali metal cations per carbon atom. FIG. 10 makes a similar showing at 1300° F. for a mixture of potassium chloride and sodium sulfate that is equimolar in potassium and sodium. As in previous Figures, the expected gasification rates, the weighted average of the rates obtained for each individual alkali metal salt alone, are represented by a dashed line and were calculated as described in reference to FIG. 2.

Figure 11:
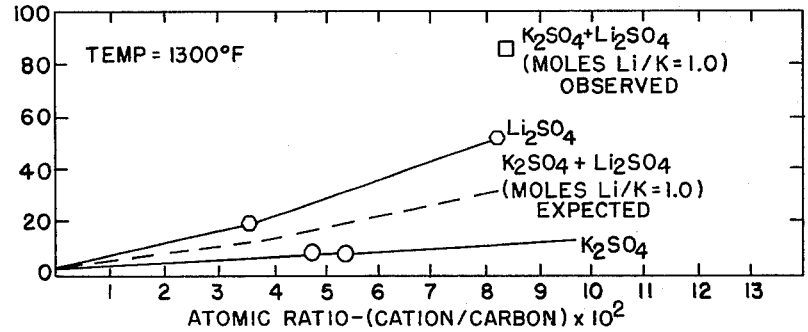
FIG. 11 is a plot illustrating that unexpectedly high gasification rates are obtained at 1300° F. by using a mixture of potassium sulfate and lithium sulfate which is equimolar in potassium and lithium to catalyze the gasification of a high rank coal.

FIG. 11 illustrates that a catalyst comprised of a mixture of a relatively noncatalytic potassium salt and a lithium salt—in lieu of a sodium salt—will also yield unexpectedly high gasification rates. It can be seen in FIG. 11 that surprisingly high gasification rates are obtained when char is gasified at 1300° F. in the presence of a mixture of potassium sulfate and lithium sulfate that is equimolar in potassium and lithium. As in prior Figures, the dashed line represents the weighted average of the separate rates obtained with the individual alkali metal salts.

Figure 12:
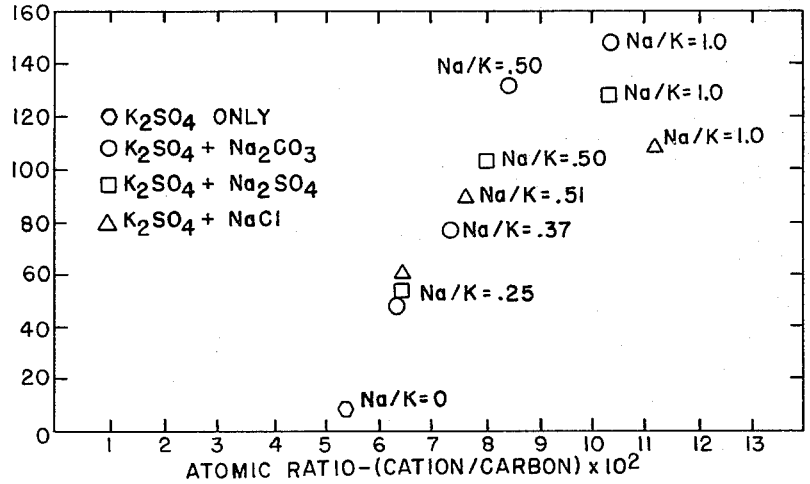
FIG. 12 is a plot illustrating that the addition of small amounts of various sodium salts will activate relatively noncatalytic potassium sulfate thereby rapidly increasing the gasification rate of a carbonaceous material.

FIG. 12 shows the gasification rates obtained when Illinois No. 6 coal char was gasified at 1300° F. in the presence of catalysts comprised of mixtures of potassium sulfate and varying amounts of either sodium carbonate, sodium sulfate or sodium chloride. In all cases the potassium sulfate was present in quantities such that the atomic ratio of potassium cations-to-carbon atoms ranged between about 0.051 and about 0.057. The amount of the particular sodium salt present was varied over a range such that the ratio of sodium cations to potassium cations present per carbon atom ranged from 0.25 to 1.0. This ratio (Na/K) is indicated next to each point plotted in the Figure. For comparison purposes, the rate of 8% carbon per hour obtained for the use of potassium sulfate alone (Na/K=0) is also shown in the Figure. It can be seen from the plotted data that for each combination of potassium sulfate and one of the three sodium salts, the presence of only a small amount of the sodium salt (Na/K=0.25) resulted in a sharp increase in the gasification rate over that for a zero concentration of the sodium salt. The gasification rate continued to increase as the amount of the sodium salt in the mixture was increased up to a sodium-to-potassium atomic ratio of 1.0.

Figure 13:
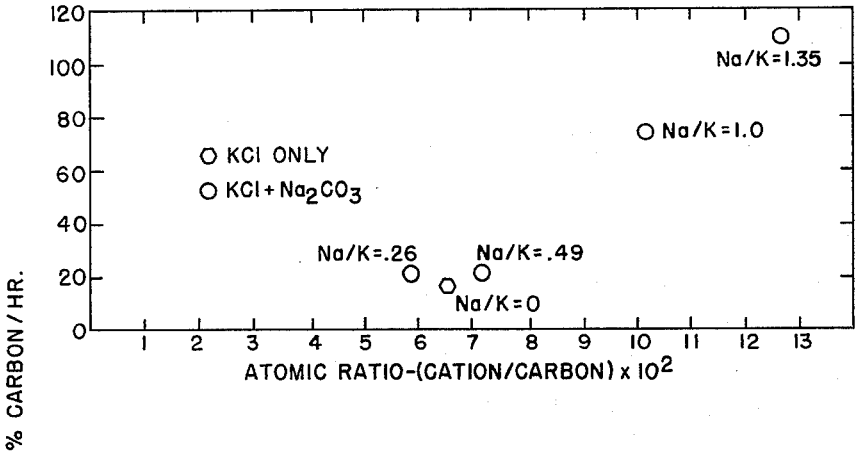
FIG. 13 is a plot illustrating that the catalytic gasification activity of relatively non-catalytic potassium chloride can be substantially increased by adding sodium carbonate in an amount sufficient to yield a sodium-to-potassium mole ratio of 1.0 or greater.

FIG. 13 is a plot similar to that of FIG. 12 except that the gasification rates plotted are for a catalyst comprised of a mixture of potassium chloride and varying amounts of sodium carbonate. For comparison purposes, the rate of 18% carbon per hour for the use of potassium chloride alone (Na/K=0) is also shown in the Figure. As can be seen in the Figure, small amounts of the sodium carbonate (Na/K=0.26 to 0.49) do not substantially increase the gasification rate. It is only when the amount of sodium carbonate in the mixture is sufficient to provide a sodium-to-potassium atomic ratio of 0.49 or greater that the gasification rate rises rapidly. In view of the data set forth in FIGS. 12 and 13, it can be concluded that small amounts of certain sodium compounds will catalytically activate poorly catalytic potassium sulfate; whereas greater amounts are necessary to activate poorly catalytic potassium chloride.

In the second series of tests, gasification rate data were obtained for Wyodak coal, a low rank subbituminous coal, in the same manner as described in the preceding series of tests except that data were obtained only for potassium sulfate, sodium carbonate, sodium sulfate and combinations thereof at 1300° F. The results of these tests are set forth in FIG. 14.

Figure 14:
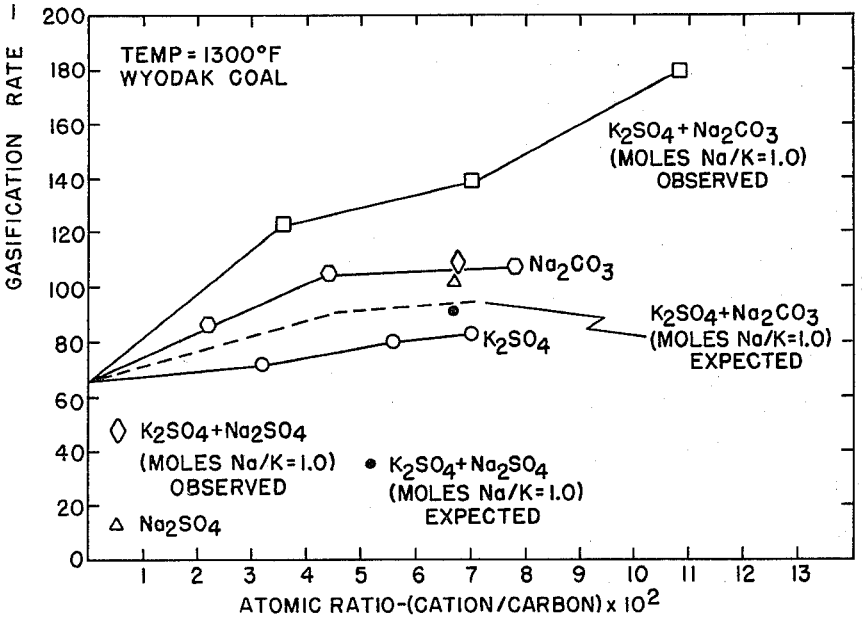
FIG. 14 is a plot illustrating that unexpectedly high gasification rates are obtained by using mixtures of potassium sulfate and sodium carbonate, and potassium sulfate and sodium sulfate which are equimolar in potassium and sodium to catalyze the gasification of a low rank coal.

As can be seen in FIG. 14, the observed gasification rates of Wyodak coal using a mixture of potassium sulfate and sodium carbonate that was equimolar in potassium and sodium were much greater than the weighted average of the gasification rates observed when using potassium sulfate alone and sodium carbonate alone. The weighted average rates are represented by the dashed line and are the rates that would normally be expected. Also shown in the Figure are single points representing gasification rates obtained for sodium sulfate alone and for a mixture of potassium sulfate and sodium sulfate. The single black dot represents the weighted average of the rates for potassium sulfate alone and sodium sulfate alone. As can be seen, the rate observed for the mixture is surprisingly greater than the expected rate represented by the black dot. The data set forth in FIG. 14 illustrate that the same unexpected gasification rates obtained in the first series of tests using mixtures of potassium sulfate and various sodium salts with a high rank coal are obtained using the same mixtures with a low rank coal.

The third series of tests was conducted in a pilot plant to determine the effect of pressure on gasification rates. Illinois No. 6 coal crushed to a size between about 30 and about 100 mesh on the U.S. Sieve Series Scale was placed in solutions containing predetermined amounts of potassium carbonate, sodium carbonate and a mixture of predetermined amounts of potassium sulfate and sodium carbonate. The resultant slurry was soaked overnight in a vacuum oven to impregnate the alkali metal salts onto the coal. The impregnated coal was then devolatilized at atmospheric pressure for 30 minutes in a muffle furnace under a nitrogen atmosphere at 1200° F. to produce char. About 20 grams of the resultant char were placed in a fixed bed reactor and contacted with downflowing steam at a temperature of 1300° F. and pressures of 0 psig and 500 psig. The product gas generated was treated to condense and remove unreacted steam and then analyzed for methane, carbon monoxide and carbon dioxide content. The gasification rate was calculated from the flow rate of the dry product gas and the concentration of methane, carbon monoxide and carbon dioxide. During these tests it was observed that the gasification rate was independent of pressure when the potassium carbonate alone was used as a catalyst. The remaining results of these tests are set forth below in Table I.

TABLE I

| | Gasification Rates - % Carbon/Hr* | | | | | |
|---|---|---|---|---|---|---|
| | Steam Rate (6 cc $H_2O$/Hr) | | | Steam Rate (24 cc $H_2O$/Hr) | | |
| Alkali Metal Salt | 0 psig | 500 psig | Percent Reduction in Rate | 0 psig | 500 psig | Percent Reduction in Rate |
| $K_2SO_4$ + $NaCO_3$** | 36.5 | 26.2 | 28.2 | 81.0 | 57.4 | 29.1 |
| $Na_2CO_3$*** | 23.0 | 14.6 | 36.5 | 61.7 | 41.1 | 33.4 |

*Weighted average rate over interval of 0-90% carbon conversion.
**Mixture was equimolar in potassium and sodium.
***Sufficient $Na_2CO_3$ used to yield a sodium-to-carbon atomic ratio equivalent to the alkali metal-to-carbon atomic ratio of the $K_2SO_4$—$Na_2CO_3$ mixture.

As can be seen from Table I, for both steam rates the gasification rate obtained with a mixture of potassium sulfate and sodium carbonate decreased as the pressure increased. The gasification rate obtained with sodium carbonate alone also decreased with increasing pressure. The gasification rate for potassium sulfate alone would not be expected to vary with pressure since pressure was observed to have no effect on the gasification rates obtained with potassium carbonate alone. It can be concluded from the result of these tests that although the gasification rates for the mixture of potassium sulfate and sodium carbonate decreased with increasing pressure, they would still remain greater than the weighted average of the rates obtained with potassium sulfate alone and sodium carbonate alone since the observed rates for sodium carbonate decreased in a greater percentage than the mixture and no decrease would be expected when potassium sulfate alone was used. Thus, pressure variations will not affect the unexpected results observed for the various mixtures of potassium and sodium salts utilized in the first two series of tests.

It will be apparent from the foregoing that the invention provides a process for gasifying a carbonaceous material which makes it possible to employ mixtures of inexpensive alkali metal salts as catalysts and at the same time attain gasification rates nearly as high as those obtainable by the use of expensive potassium carbonate. As a result, the overall cost of the product gas may be substantially reduced.

We claim:

1. A process for the catalytic steam gasification of coal which comprises:

(a) introducing said coal into a reaction zone;

(b) introducing potassium sulfate into said reaction zone;

(c) introducing into said reaction zone in a sufficient quantity to activate said potassium sulfate a sodium or lithium compound selected from the group consisting of sodium sulfate, sodium carbonate, sodium chloride, sodium nitrate, and lithium sulfate; and (d) gasifying said coal with steam in said reaction zone at a temperature between about 1200° F. and about 1400° F. thereby obtaining a gasification rate that is substantially greater than the weighted average of the separate gasification rates obtained by introducing only said potassium sulfate into said reaction zone and by introducing only said sodium or said lithium compound into said reaction zone, wherein said weighted average is based upon the concentration of said potassium sulfate and said sodium or said lithium compounds expressed respectively in potassium-to-carbon and sodium-to-carbon or lithium-to-carbon atomic ratios.

2. A process as defined by claim 1 wherein said coal, said potassium sulfate and said sodium or lithium compound are simultaneously introduced into said reaction zone.

3. A process as defined by claim 1 wherein said coal is impregnated with an aqueous solution of said potassium sulfate and said sodium or lithium compound prior to the introduction of said coal into said reaction zone.

4. A process as defined by claim 1 wherein said sodium compound comprises sodium carbonate.

5. A process as defined by claim 1 wherein said sodium compound comprises sodium sulfate.

6. A process as defined by claim 1 wherein said sodium compound comprises sodium chloride.

7. A process as defined by claim 1 wherein said sodium compound comprises sodium nitrate.

8. A process as defined by claim 1 wherein said lithium compound comprises lithium sulfate.

9. A process as defined by claim 1 wherein said coal comprises bituminous coal.

10. A process as defined by claim 1 wherein said coal comprises subbituminous coal.

11. A process as defined by claim 1 wherein said coal comprises lignite.

12. A process as defined by claim 1 wherein said coal, said potassium sulfate and said sodium or lithium compound are mixed together prior to their introduction into said reaction zone.

13. A process for the catalytic steam gasification of coal which comprises:

(a) introducing said coal into a reaction zone;

(b) introducing potassium chloride and sodium sulfate into said reaction zone, said sodium sulfate being present in a sufficient quantity to activate said potassium chloride; and (c) gasifying said coal with steam in said reaction zone at a temperature between about 1200° F. and about 1400° F. thereby obtaining a gasification rate that is substantially greater than the weighted average of the separate gasification rates obtained by introducing only said potassium chloride into said reaction zone and by introducing only said sodium sulfate into said reaction zone wherein said weighted average is based upon the concentration of said potassium chloride and said sodium sulfate expressed respectively in potassium-to-carbon and sodium-to-carbon atomic ratios.

14. A process as defined by claim 13 wherein said coal, said potassium chloride and said sodium sulfate are simultaneously introduced into said reaction zone.

15. A process as defined by claim 13 wherein said coal is impregnated with said potassium chloride and said sodium sulfate prior to the introduction of said coal into said reaction zone.

16. A process as defined by claim 13 wherein sufficient potassium chloride and sodium sulfate are introduced into said reaction zone to provide an alkali metal cation-to-carbon atomic ratio greater than about 0.08.

* * * * *